US006196986B1

(12) United States Patent
Gardiner

(10) Patent No.: US 6,196,986 B1
(45) Date of Patent: Mar. 6, 2001

(54) FOOT PROTECTOR FOR SAND SOCCER

(76) Inventor: Edward L. Gardiner, 263 Browns Rd., Storrs, CT (US) 06268

( * ) Notice: Subject to any disclaimer, the term of this patent is extended or adjusted under 35 U.S.C. 154(b) by 0 days.

(21) Appl. No.: 09/289,026

(22) Filed: Apr. 9, 1999

(51) Int. Cl.[7] ..... A61F 13/00

(52) U.S. Cl. ..... 602/63; 602/27; 602/65; 128/882; 128/892

(58) Field of Search ..... 128/882, 892, 128/893; 602/65, 27, 63, 62, 61, 66, 28–29, 23

(56) References Cited

U.S. PATENT DOCUMENTS

D. 321,971 12/1991 Bajork .
3,506,000 4/1970 Baker .
4,476,858 * 10/1984 Curtis .
4,677,765 7/1987 Lubet et al. .
4,769,854 9/1988 Williams .
5,020,164 6/1991 Edwards .
5,412,957 5/1995 Bradberry et al. .
5,513,450 5/1996 Aviles Palazzo .
5,643,183 * 7/1997 Hill .
5,749,100 5/1998 Rosenberg .
5,774,898 7/1998 Malpee .

* cited by examiner

*Primary Examiner*—Michael A. Brown
*Assistant Examiner*—Lalita M. Hamilton
(74) *Attorney, Agent, or Firm*—Cantor Colburn LLP

(57) ABSTRACT

A foot protector including a generally tubular foot portion for surrounding a portion of a wearer's foot. The foot portion has a front opening for receiving the wearer's toes. An ankle strap is coupled to the foot portion and the ankle strap and foot portion define an access opening and a heel opening for receiving the wearer's heel. An ankle cover is coupled to the ankle strap for encompassing the wearer's ankle.

7 Claims, 4 Drawing Sheets

FOOT PROTECTOR FOR SAND SOCCER

BACKGROUND OF THE INVENTION

The invention relates generally to foot protectors and in particular to a foot protector for use in playing soccer on sand. Beach soccer has become an increasingly popular sport for both recreation and competition. When played in bare feet, a player's feet often become irritated due to the accumulation of sand on the ball which acts as an abrasive against the player's feet. Enclosed footwear (such as sneakers) has disadvantages such as accumulation of sand. In addition, enclosed footwear prevents the player from contacting the ball with the toes and thus reduces control. Accordingly, there is a perceived need in the art for a foot protector that provides foot protection but still allows flexibility and control.

SUMMARY OF THE INVENTION

The above-discussed and other drawbacks and deficiencies of the prior art are overcome or alleviated by the foot protector of the present invention. In an exemplary embodiment, the foot protector includes a generally tubular foot portion for surrounding a portion of a wearer's foot. The foot portion has a front opening for receiving the wearer's toes. An ankle strap is coupled to the foot portion and the ankle strap and foot portion define an access opening and a heel opening for receiving the wearer's heel. An ankle cover is coupled to the ankle strap for encompassing the wearer's ankle.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
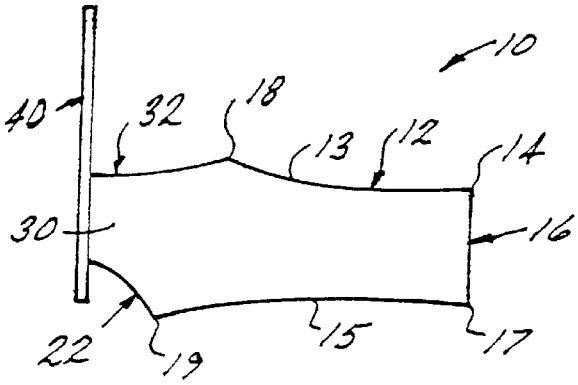
FIG. 1 is a side view of a foot protector in an exemplary embodiment of the invention.

FIG. 1 is a side view of a right foot protector 10 in an exemplary embodiment of the invention. The foot protector 10 is made from a resilient material so that it clings to the wearer's foot. In an exemplary embodiment, the foot protector 10 is made from neoprene. The foot protector 10 includes a generally tubular foot portion 12, an ankle strap 30 and an ankle cover 40. The foot portion 12 has a top surface 13 and a bottom surface 15. The top surface 13 has a front edge 14 which terminates at front opening 16. Front edge 14 is positioned at the base of the wearer's toes. The top surface 13 also includes a rear edge 18 which is located on the top of the wearer's foot. The rear edge 18 should be positioned prior to the tarsus of the foot where articulation between the foot and leg occurs. Thus, the top surface 13 terminates at rear edge 18 prior to the wearer's ankle and provides flexibility to the foot-ankle joint. The bottom surface 15 has a front edge 17 contiguous with front edge 14 and is positioned at the base of the wearer's toes. The bottom surface 15 includes a rear edge 19 which is positioned at the edge of the heel of the wearer's foot.

Ankle strap 30 is generally unshaped and is coupled at each end to the sides of foot portion 12. The ankle strap 30 and edge 19 define a heel opening 22 for receiving the wearer's heel. The ankle strap 30 and rear edge 18 define an access opening 32 for receiving the wearer's foot.

Figure 2:
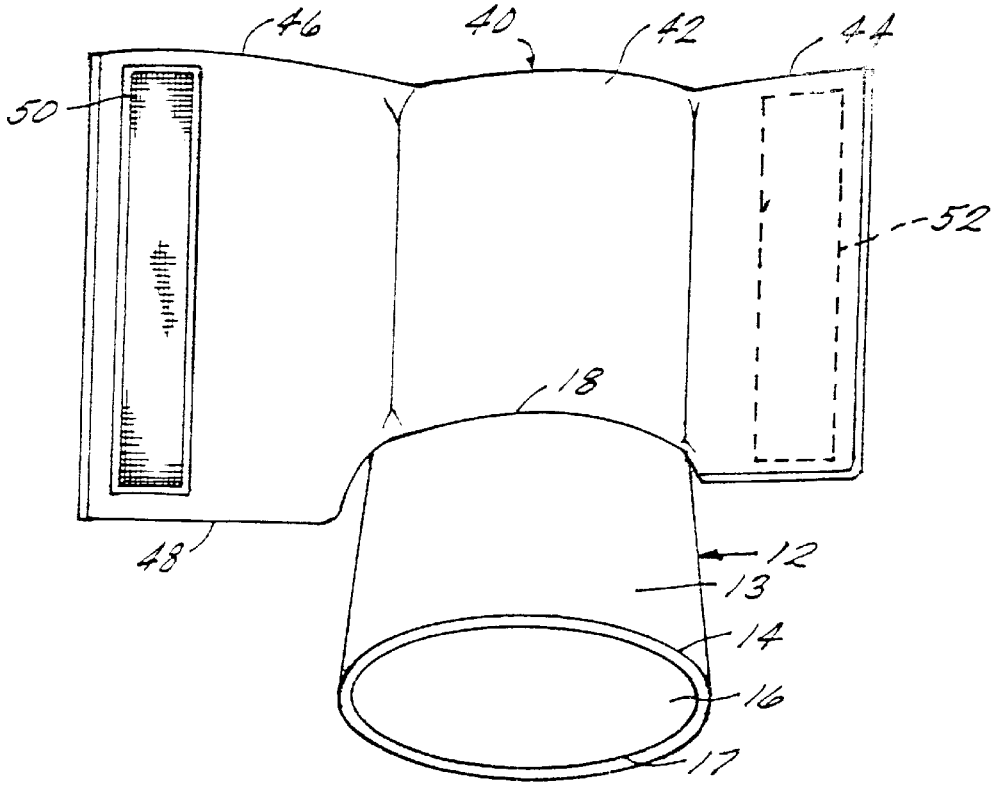
FIG. 2 is a front view of a right foot protector in an exemplary embodiment of the invention.

Ankle cover 40 is provided to encircle the wearer's ankle and a portion of the wearer's leg. The ankle cover 40 provides support and prevents sand from entering foot portion 12. As shown in FIG. 2, the ankle cover 40 has a central portion 42 which is positioned behind the wearer's ankle. A first extension 44 and a second extension 46 are coupled to the central portion 42. The second extension 46 is sized so that lower edge 48 overlaps rear edge 18 on the top surface 13 of foot portion 12 when the foot protector is worn. This reduces the ingress of sand into foot portion 12. The inside surface of second extension 46 includes a first fastener 50 (e.g., hook material) for engaging a second fastener 52 (e.g., loop material) on the outside surface of first extension 44.

Figure 3:
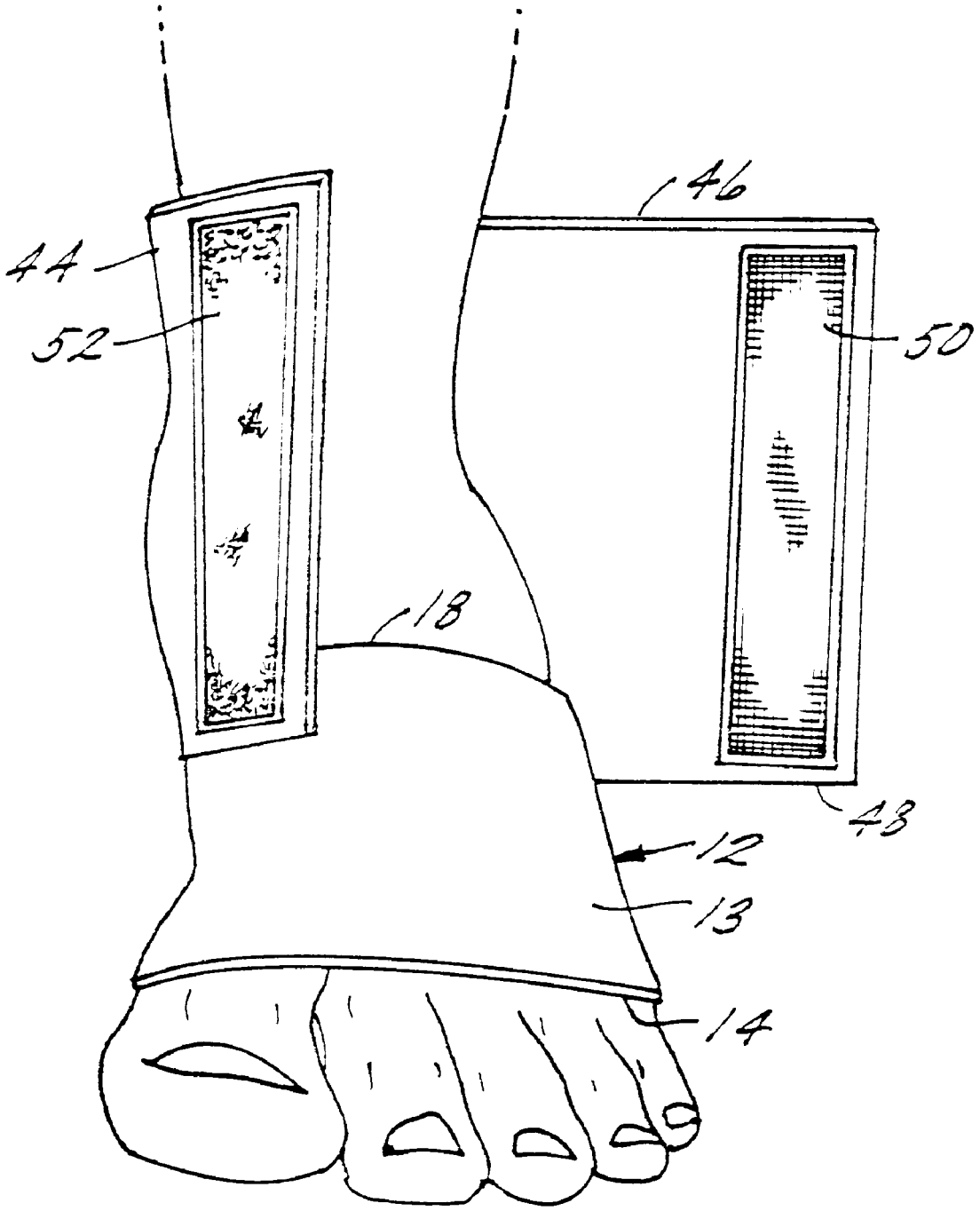
FIG. 3 is a front view of a left foot protector being worn.

FIG. 3 is front view of a left foot protector 10 positioned on a foot. As shown in FIG. 3, the front edge 14 is positioned at the base of the wearer's toes. This allows the toes to contact the ball and provides for enhanced control and balance. Rear edge 18 of top surface 13 is positioned on the top of the foot prior to the ankle joint. This provides flexibility to the foot-ankle joint. The ankle cover 40 is shown partially positioned on the wearer's ankle with first extension 44 placed against the wearer's ankle. Second extension 46 is wrapped about the ankle so that first fastener 50 engages second fastener 52.

Figure 4:
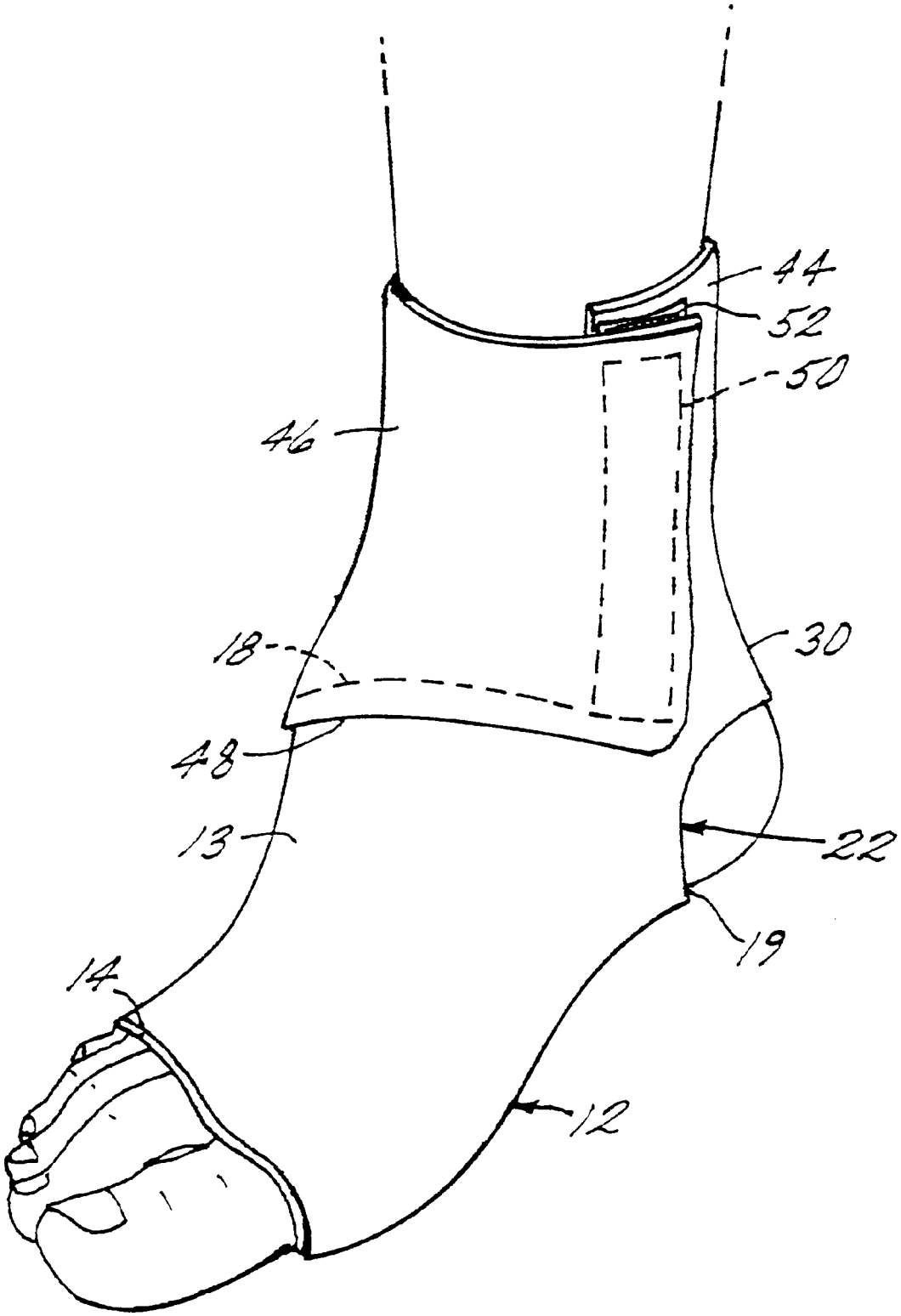
FIG. 4 is a perspective view of a right foot protector being worn.
Figure 5:
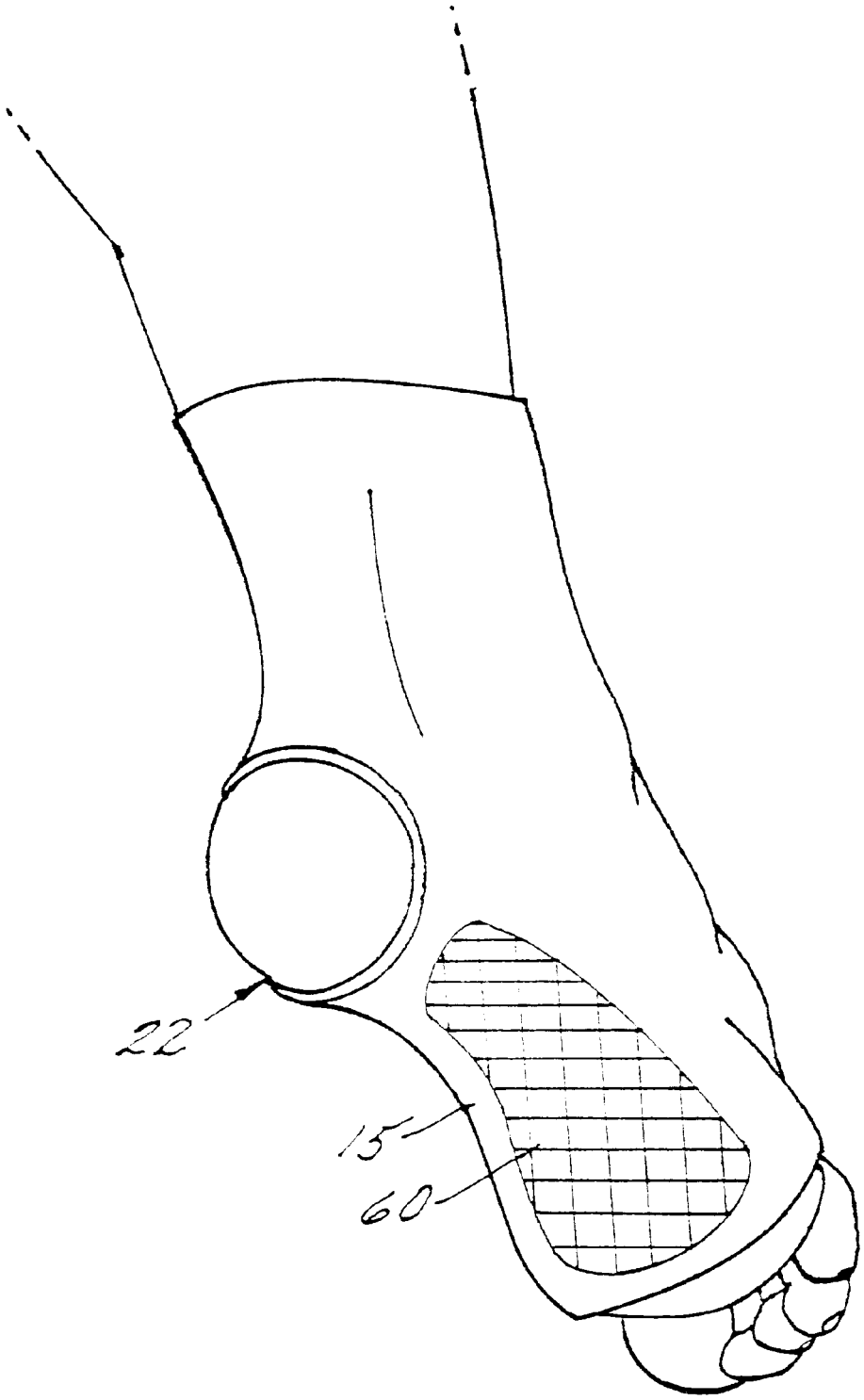
FIG. 5 is another perspective view of the right foot protector being worn.

FIG. 4 shows a right foot protector placed on a wearer's foot. As described above, the junction between the ankle strap 30 and foot portion 12 defines opening 22 for the heel of the foot. The exposed heel provides for better fit and less friction on the wearer. Also shown in FIG. 4 is the overlap of edge 48 on second extension 46 over rear edge 18 of top surface 13. FIG. 5 is a perspective view of the right foot protector showing a textured bottom surface 60 which enhances traction. The textured surface may formed by coupling (e.g., through an adhesive) a texturized sheet (e.g., rubber) to the bottom surface 15 of the foot portion 12.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A foot protector for use in sand soccer, the foot protector comprising:

a generally tubular foot portion for surrounding a portion of a wearer's foot, said foot portion having a front opening for receiving the wearer's toes;

an ankle strap coupled to said foot portion, said ankle strap and foot portion defining an access opening and a heel opening for receiving the wearer's heel; and an ankle cover coupled to said ankle strap for encompassing the wearer's ankle;

wherein said ankle cover includes:

a central portion for placement behind the wearer's ankle;

a first extension extending from said central portion, said first extension having a first fastener; and a second extension extending from said central portion, said second extension having a second fastener for mating with said first fastener; wherein:

said foot portion includes a top surface having a rear edge for placement adjacent to the tarsus of the foot; and said second extension has a lower edge for overlapping said rear edge.

2. The foot protector of claim 1 wherein:

said foot portion has a top surface having a front edge terminating at the base of the wearer's toes.

3. The foot protector of claim 2 wherein:

said foot portion has a bottom surface having a front edge terminating at the base of the wearer's toes.

4. The foot protector of claim 2 wherein:

said top surface has a rear edge for placement adjacent to the tarsus of the foot.

5. The foot protector of claim 1 wherein:

said first fastener is hook material.

6. The foot protector of claim 5 wherein:

said second fastener is loop material.

7. The foot protector of claim 1 further comprising:

a texturized sheet connected to a bottom surface of said foot portion.

* * * * *